US005946833A

United States Patent [19]

Böttcher et al.

[11] Patent Number: 5,946,833

[45] Date of Patent: Sep. 7, 1999

[54] FOLDING IRONING BOARD WITH PUSH ARM

[75] Inventors: Wolfram-Dietrich Böttcher, Mötzingen; Joachim Krauss, Wildberg; Reinhold Oettl, Nufringen; Ronald Walther, Nagold, all of Germany

[73] Assignee: Häfele GmbH & Co., Nagold, Germany

[21] Appl. No.: 09/071,788

[22] Filed: May 1, 1998

[30] Foreign Application Priority Data

May 1, 1997 [DE] Germany ..... 297 07 831

[51] Int. Cl.[6] ..... D06F 81/00

[52] U.S. Cl. ..... 38/139

[58] Field of Search ..... 38/139, 138, 137, 38/103; 158/63, 637, 74, 167, 115

[56] References Cited

U.S. PATENT DOCUMENTS

| | | | |
|---|---|---|---|
| 2,808,667 | 10/1957 | Witmer | 38/139 |
| 3,129,676 | 4/1964 | Brooks et al. | 108/33 |
| 4,637,321 | 1/1987 | Hasler et al. | 108/72 |
| 5,421,766 | 6/1995 | Walz et al. | 38/139 X |

FOREIGN PATENT DOCUMENTS

| | | | |
|---|---|---|---|
| 641354 | 9/1993 | Australia | 38/139 |

*Primary Examiner*—Ismael Izaguirre
*Attorney, Agent, or Firm*—Friedrich Kueffner

[57] ABSTRACT

An ironing board with a front component which is foldable onto a rear component and with a support carrier for the front component, wherein the support carrier is longitudinally slideably arranged on the rear component and the front component can be moved forwardly beyond the rear component by a pivoting movement of the ironing board. The ironing board further includes a push arm which is connected in an articulated manner to the support carrier and the front component, wherein the hinge connection at the support carrier is located in the pull-out direction of the support carrier in front of the hinge connection at the front component.

8 Claims, 4 Drawing Sheets

FOLDING IRONING BOARD WITH PUSH ARM

BACKGROUND OF THE INVENTION

1. Field of the Invention

The present invention relates to an ironing board with a front component which is foldable onto a rear component and with a support carrier for the front component, wherein the support carrier is longitudinally slideably arranged on the rear component and the front component can be moved forwardly beyond the rear component by a pivoting movement of the ironing board.

2. Description of the Related Art

In ironing boards of the above-described type, the rear component together with the folded-out front component are arranged on a pull member slideably supported in a guide means so as to be pivotable through at least one parallelogram lever pair from a lower position of rest into an upper work position. The support carrier is connected in an articulated manner through a push arm to the pull member in such a way that when the rear component and the front component are pivoted upwardly, the support carrier is moved automatically by means of the parallelogram lever pair into a position for supporting the front component when the ironing board is extended. The front component can then be pivoted manually until it makes contact with the support carrier.

However, there are also foldable ironing boards which are not pivoted from a lower position into an upper work position by means of parallelogram levers and in which an automatic extension of the support carrier for the front component would also be desirable.

SUMMARY OF THE INVENTION

Therefore, it is the primary object of the present invention to further develop an ironing board of the above-described type in such a way that the support carrier can be moved out automatically into a supporting position through a mechanism which is as simple as possible.

In accordance with the present invention, the ironing board includes a push arm which is connected in an articulated manner to the support carrier and the front component, wherein the hinge connection at the support carrier is located in the pull-out direction of the support carrier in front of the hinge connection at the front component.

The support carrier is coupled for movement through the push arm to the front component in such a way that, when the front component is pivoted from its folded-up position into its work position in which the front component and the rear component form a flat support surface, the support arm is moved forwardly so as to form a support for the front component. When this is carried out, the support carrier is preferably moved out until it is completely in its end position. The offset arrangement of the two hinge connections in pull-out direction ensures that the push arm is directed in the pull-out direction of the support carrier, and, thus, the upward pivoting movement of the front component is converted into a component of movement which acts on the support carrier in the pull-out direction.

In accordance with an especially preferred embodiment of the invention, the push arm is constructed resiliently at least in the pull-out direction, so that any distance changes between the two hinge connections of the push arm which occur when the front component is pulled up can be compensated by the elastic deformation of the push arm. In addition, the support may be spring-biased in pull-out direction by a resilient push arm, so that, for example, during the initial upward pivoting movement of the front component, the support arm is pretensioned in a forward direction and can jump slightly forwardly.

In accordance with another feature, the push arm is displaceably mounted on the support carrier and/or the front component. This makes it possible to shift the hinge point of the push arm at the support carrier or at the front component in accordance with the upward pivoting movement of the front component.

In accordance with a preferred embodiment of the invention, a push arm is provided on both sides of the support carrier, so that any transverse forces acting transversely of the pull-out direction of the support carrier are compensated against each other.

In accordance with a particularly preferred embodiment of the invention, the push arm is constructed as a preferably fork-shaped wire stirrup whose spring action can be adjusted as desired, for example, through its cross-sectional thickness. Such a fork-shaped wire stirrup can be easily manufactured by bending and can be "threaded in" without problems through bearing bores or bearing sleeves in the front component or in the support carrier.

In accordance with an advantageous further development of this embodiment, the wire stirrup has in the pull-out direction a middle portion for the hinge connection with the support carrier and outer portions on each side for the hinge connection to the front component. These middle and side portions form the pivoting axes of the push arm at the front component and the support carrier.

In accordance with another further development of the invention, the wire stirrup is angled between the two hinge connections, so that a certain spring action is achieved in this area. Also, for example, during the initial upward pivoting movement of the front component, the support arm can be pretensioned in the pull-out direction.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
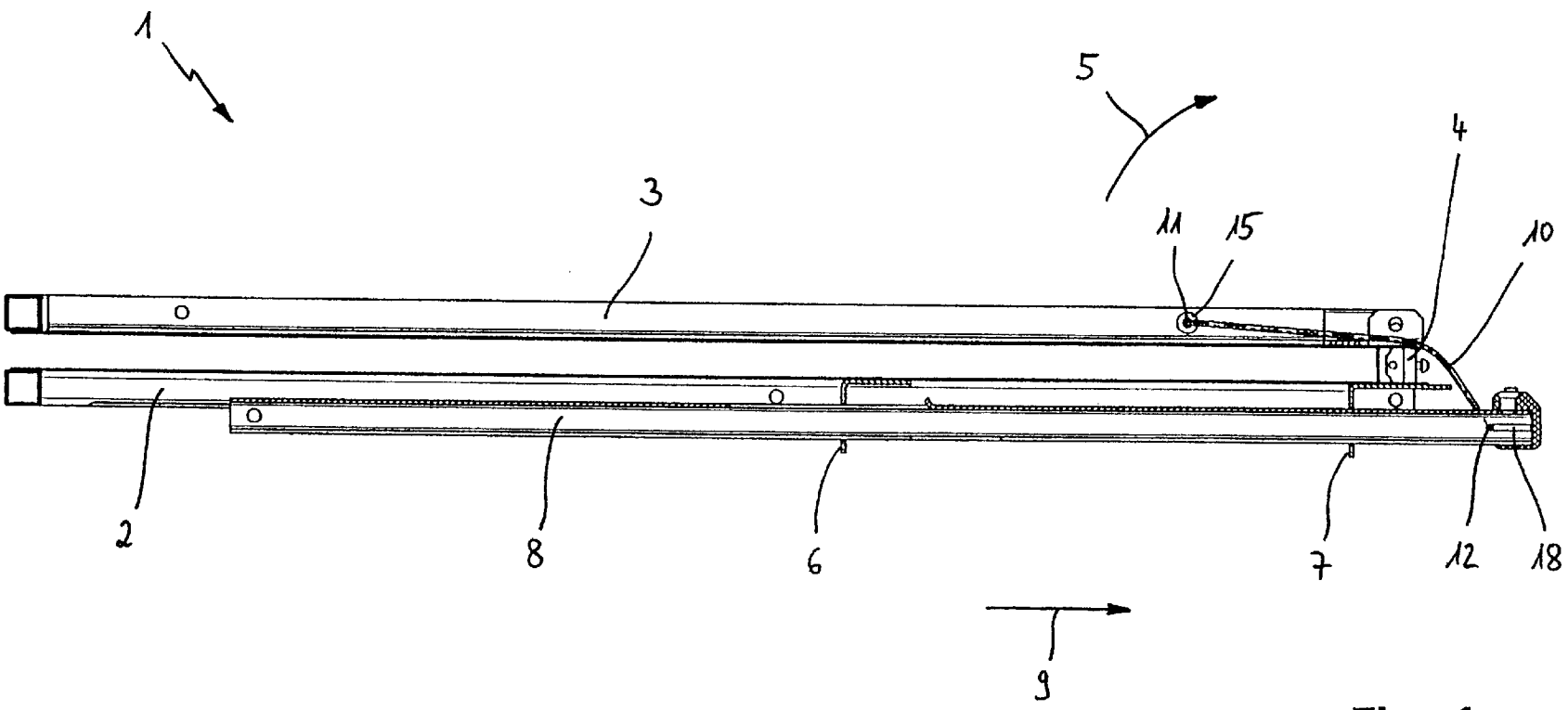
FIG. 1 is a side view of an ironing board according to the present invention shown in the initial position with the front component being folded onto the rear component.
Figure 2:
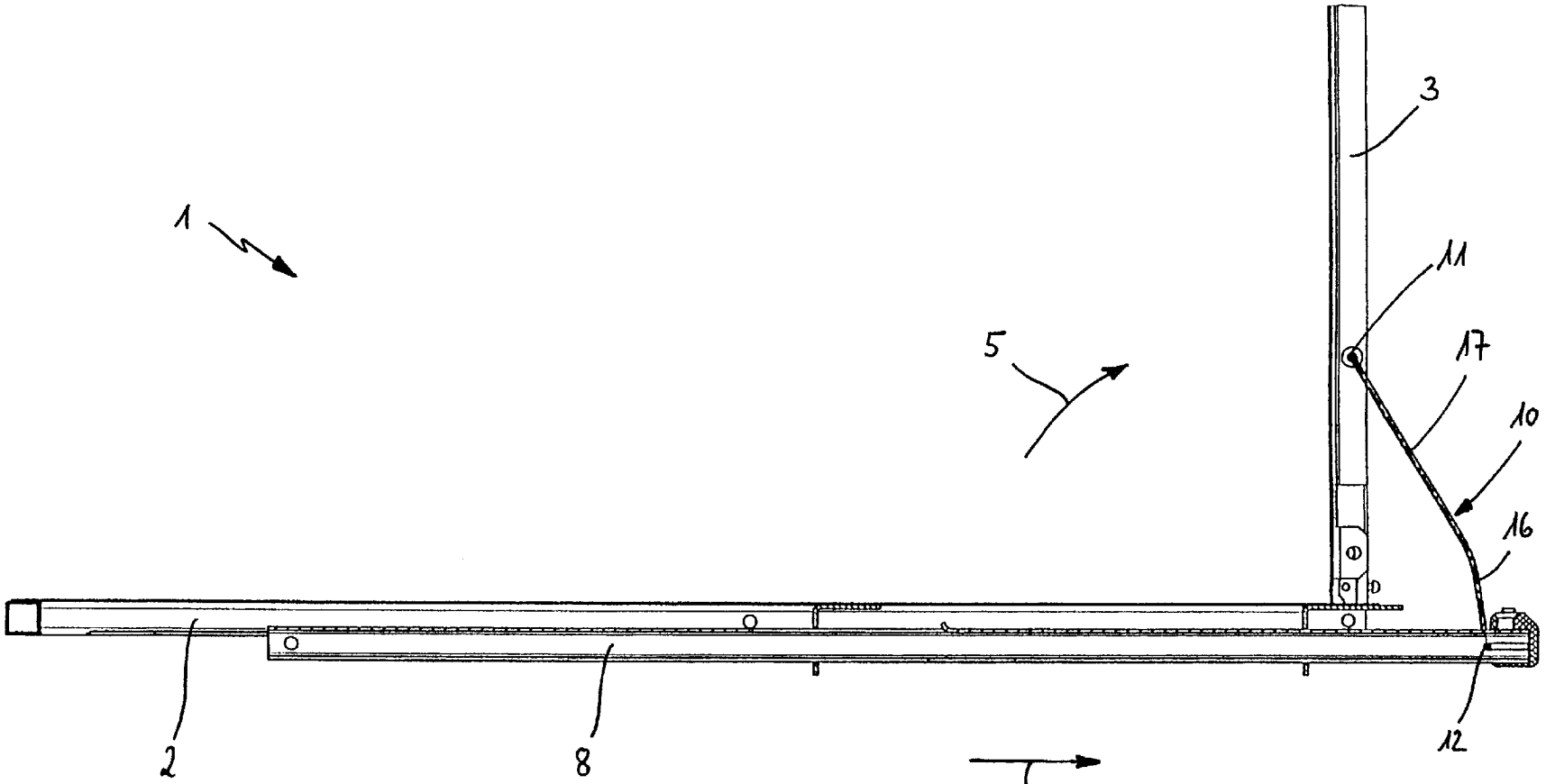
FIG. 2 is a side view of the ironing board of FIG. 1 shown with the front component pivoted upwardly in a middle position.
Figure 3:
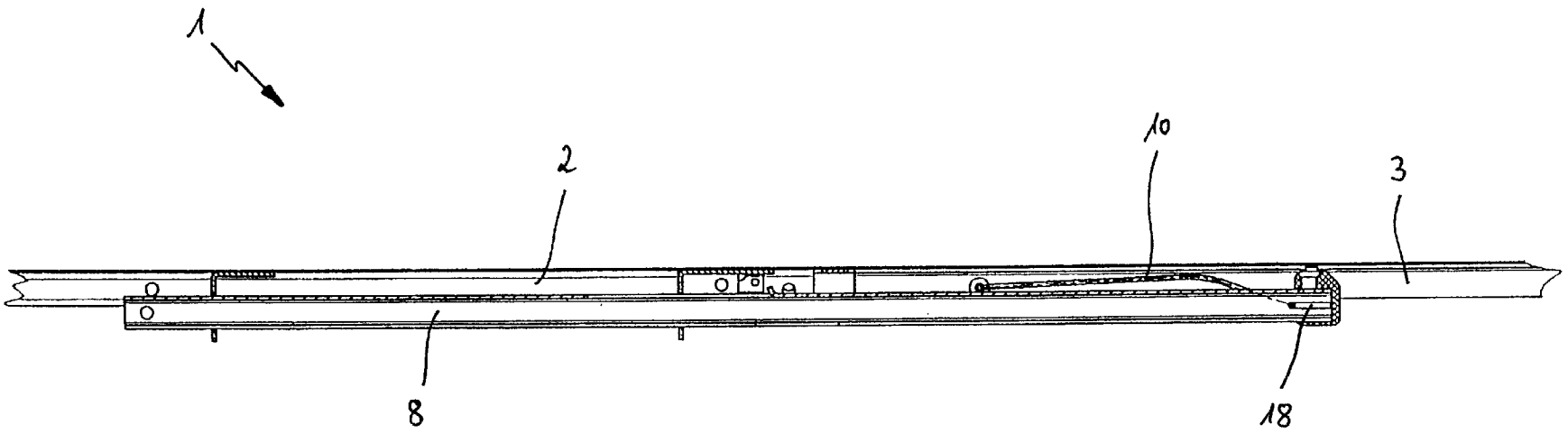
FIG. 3 is a side view of the ironing board of FIG. 1 shown in its work position with the front component being completely folded out.

FIGS. 1 to 3 of the drawing show an ironing board 1 whose work surface is formed by a rear component 2 and a front component 3. The front component 3 is mounted on the rear component 2 through a hinge 4 and can be pivoted upwardly from its initial position shown in FIG. 1 in the direction of arrow 5 into its work position shown in FIG. 3 in which the rear component 2 and the front component 3 form a flat support surface. A support carrier 8 is longitudinally slideably in pull-out direction 9 mounted on the rear component 2 through 2 guide angles 6, 7. As can be seen in FIG. 3, the support carrier 8 serves to support the front component 3 which has been pivoted out into its work position.

In order to cause the support carrier 8 to be moved automatically when the front component 3 is pivoted upwardly into its position in which it supports the front component 3, the front end 3 of the support carrier 8 is coupled for movement through a push arm 10 to the front component 3. For this purpose, the push arm 10 is hinged at 11 to the front component 3 and at 12 to the front end of the support carrier 8, wherein the hinge connection 12 at the support carrier 8 is in pull-out direction 9 of the support carrier 8 arranged in front of the hinge connection 11 on the front component 3. In this manner, the upward pivoting movement of the front component 3 is converted through the push arm 10 which also acts in pull-out direction 9 into an outward movement of the support arm 8 in the pull-out direction 9.

As is apparent from the sequence of movements illustrated in FIGS. 1 to 3, the push arm 10 is not rigid, but of elastic construction, so that it can adjust to the changing distance between the two hinge connections 11, 12 when the front component 3 is pivoted upwardly. While the push arm 10 in its position of rest shown in FIG. 1 still compensates the height between the rear component 2 and the front component 3, i.e., the length of the hinge 4, by an angular configuration of the push arm 10, the push arm extends in the end position of the front component 3 shown in FIG. 3 more closely at the connecting line between the two hinge connections 11, 12. In order to take into consideration the changing distance between the two hinge connections 11, 12, the push arm 10 may also be slideably mounted in a guide means, not shown, on the front component 3 or on the support carrier 8.

Figure 4:
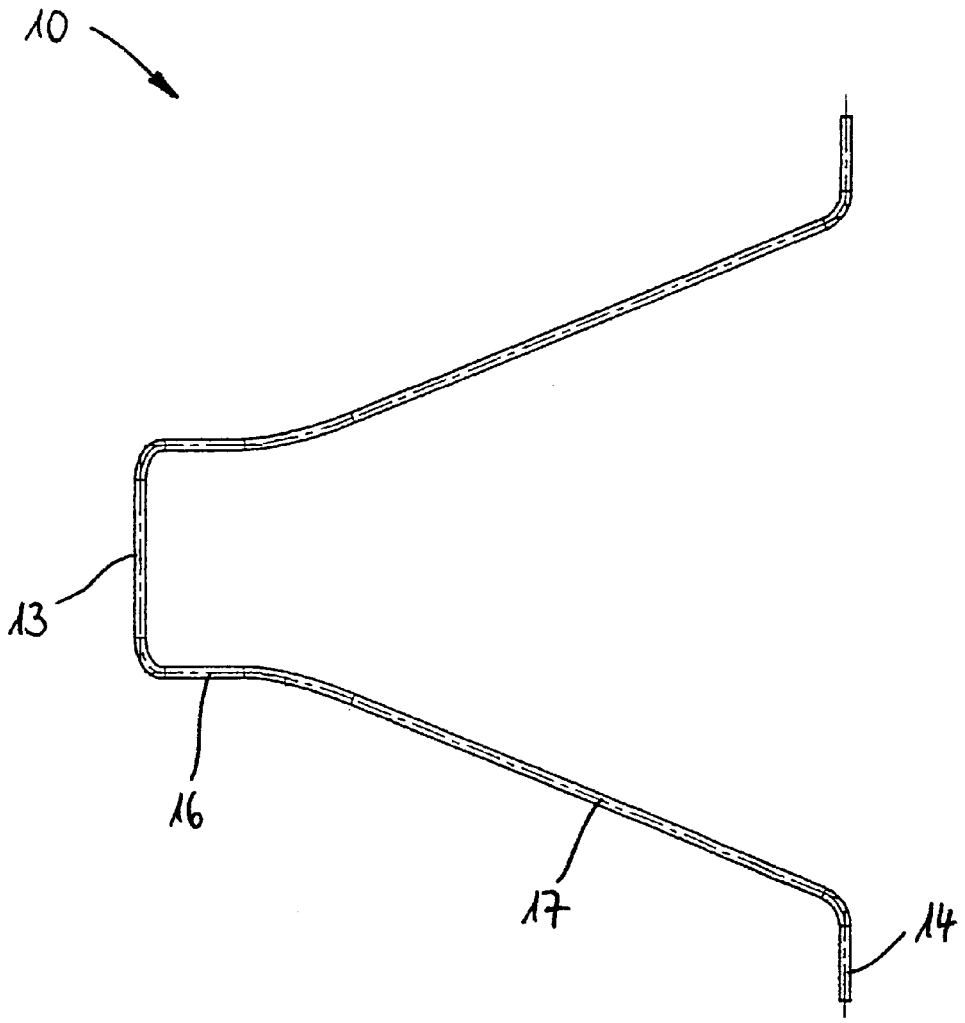
FIG. 4 is a top view of the push arm of the ironing board shown in FIGS. 1–3.
Figure 5:
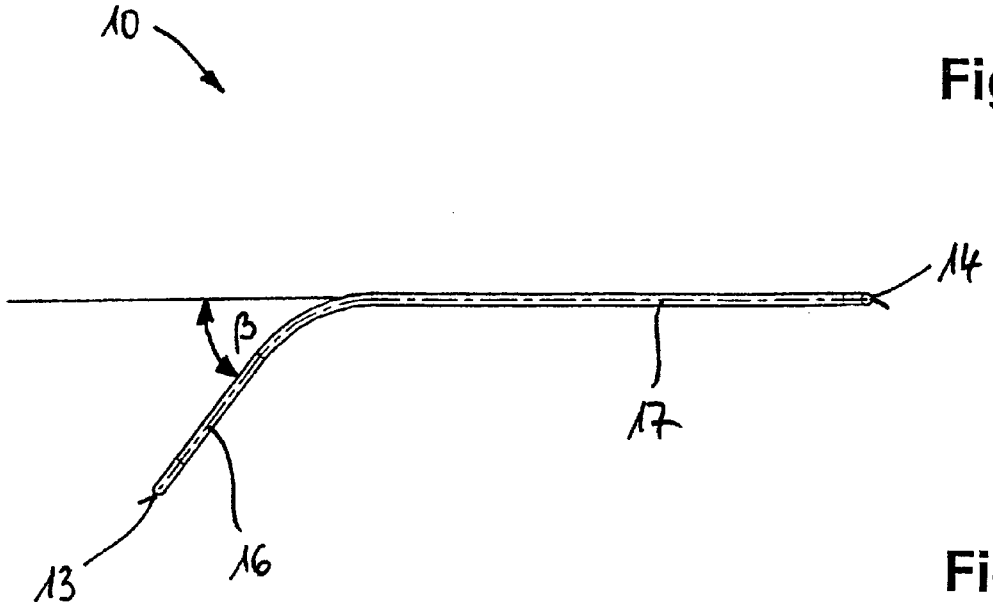
FIG. 5 is a side view of the push arm shown in FIG. 4.

As shown in FIGS. 4 and 5, the push arm 10 is constructed as a fork-shaped wire stirrup which is symmetrical with respect to its middle plane. A middle portion 13 forms the pivot axis of the rear hinge connection 12 and is supported in a bearing opening, not shown, in the support arm 8. The two outer portions 14 of the push arm 10 form the pivot axis of the rear hinge connection 12 and are mounted through bearing bushings 15 of synthetic material on the front component 3, as shown in FIG. 1. Two arms 16, 17 are provided between the middle portion 13 and the two outer portions 14, wherein the front shorter arm 16 is angled relative to the rear arm 17 by an angle β of about 52°. This angled configuration causes the support carrier 8 to be spring-biased in the pull-out direction 9 by the push arm 10 in the initial position shown in FIG. 1 and, thus, moves out in the pull-out direction 9 already during the initial upward pivoting movement of the front component 3.

A longitudinal opening 18 of the support 8 in the area of the hinge connection 12 makes it possible to thread the push arm 10 shown in FIG. 4 through the support carrier 8 and the front component 3 into its assembly position.

While specific embodiments of the invention have been shown and described in detail to illustrate the inventive principles, it will be understood that the invention may be embodied otherwise without departing from such principles.

I claim:

1. An ironing board comprising a rear component and a front component foldable onto the rear component, a support carrier for the front component mounted longitudinally displaceable on the rear component, the front component being moveable outwardly in a forward direction past the rear component by a pivoting movement of the ironing board, further comprising a push arm connected in an articulated manner at hinge connections to the support carrier and the front component, wherein the hinge connection at the support carrier is located in the forward pulling out direction of the support carrier in front of the hinge connection at the front component.

2. The ironing board according to claim 1, wherein the push arm is constructed resiliently at least in the push-out direction.

3. The ironing board according to claim 1, wherein the push arm is slideably mounted at least on one of the support carrier and the front component.

4. The ironing board according to claim 1, comprising a push arm on both sides of the support carrier.

5. The ironing board according to claim 1, wherein the push arm is a wire stirrup.

6. The ironing board according to claim 5, wherein the push arm is a fork-shaped wire stirrup.

7. The ironing board according to claim 5, wherein the wire stirrup has in the pull-out direction a middle portion for the hinge connection at the support carrier and two outer portions at the hinge connection at the front component.

8. The ironing board according to claim 5, wherein the wire stirrup has an angled configuration between the two hinge connections.

* * * * *